United States Patent [19]

Abraham et al.

[11] 4,202,399

[45] May 13, 1980

[54] SUPPORT TABLE FOR FOUNDRY SAND MOLDING APPARATUS

[75] Inventors: Edward D. Abraham, Brecksville, Ohio; Rodney L. Hartung, Muscatine, Iowa

[73] Assignee: Carver Foundry Products, Muscatine, Iowa

[21] Appl. No.: 888,380

[22] Filed: Mar. 20, 1978

[51] Int. Cl.[2] ..... B22C 15/30

[52] U.S. Cl. ..... 164/203; 164/196; 164/192

[58] Field of Search ..... 164/169, 180, 196, 197, 164/203, 207–213, 218–221, 192

[56] References Cited

U.S. PATENT DOCUMENTS

| | | | |
|---|---|---|---|
| 1,661,598 | 3/1928 | Byerlein | 164/169 |
| 2,817,127 | 12/1957 | Beech | 164/196 |

FOREIGN PATENT DOCUMENTS

| | | | |
|---|---|---|---|
| 681470 | 8/1939 | Fed. Rep. of Germany | 164/212 |
| 196024 | 5/1965 | Sweden | 164/196 |
| 255502 | 3/1970 | U.S.S.R. | 164/196 |
| 465262 | 6/1975 | U.S.S.R. | 164/196 |

*Primary Examiner*—Robert D. Baldwin
*Assistant Examiner*—K. Y. Lin

[57] ABSTRACT

A support table for foundry sand molding machines is elevated from a lowermost position to a sand supply position wherein sand is fed into a flask supported on the table. The table is then moved downwardly to a predetermined position slightly above the lowermost position while being vibrated to compact the sand. The table is then elevated to an upper position for squeezing the sand against a squeeze board carried by a head on the machine.

6 Claims, 2 Drawing Figures

16
B
94
94
92
12
86
50
48
46
46
20
44
40
54
72
60
70
42
62
54a
68
22
32
26
82
64
26
80
98
78
76
102
98a
106
84

SUPPORT TABLE FOR FOUNDRY SAND MOLDING APPARATUS

BACKGROUND OF THE INVENTION

This application relates to the art of foundry sand molding machines and, more particularly, to support tables for use in such machines.

Foundry sand molding machines commonly include a support table on which a flask is supported in surrounding relationship to a pattern. Sand is fed into the flask and the table is elevated to squeeze the head against a squeeze board carried by a head on the machine. Previous support tables of the type described have included a jolt feature for jolting the table to obtain an initial compaction of the sand before squeezing. With previous arrangements, it is not possible to obtain a plurality of different elevated positions in an economical manner while minimizing the amount of space occupied by the molding machine.

SUMMARY OF THE INVENTION

A support table for a foundry sand molding machine includes an air motor for moving same from a lowermost position to an elevated sand supply position wherein sand is fed into a flask supported on the table. The table then moves down to a predetermined or preset position slightly above the lowermost position while a vibrator operates for compacting the sand in the flask. The table is then elevated under full pressure supplied to the air motor for squeezing the sand against the squeeze board carried by a head on the machine.

In a preferred arrangement, the table is supported by a base structure, and the air motor is formed by a general cylindrical flexible diaphragm or bellows member sealingly secured between the table and base structure to define an air chamber. The air motor totally encloses moving parts and thus protects them from sand, dirt and the like.

The base structure includes a vertical guide cylinder receiving an elongated guide rod secured to the table and extending through the air chamber.

Spring means is provided between the guide rod and guide cylinder for aiding the air motor in maintaining the table in its predetermined or preset position. The spring means may take many forms and in one arrangement includes a spring biased plunger positioned in a bore in the guide rod for acting against the bottom end of the guide cylinder.

It is a principal object of the present invention to provide an improved support table for a foundry sand molding machine.

It is also an object of the present invention to provide a very compact support table for a foundry sand molding machine.

It is an additional object of the invention to provide a support table having a plurality of different elevated positions.

DESCRIPTION OF A PREFERRED EMBODIMENT

Figure 1:
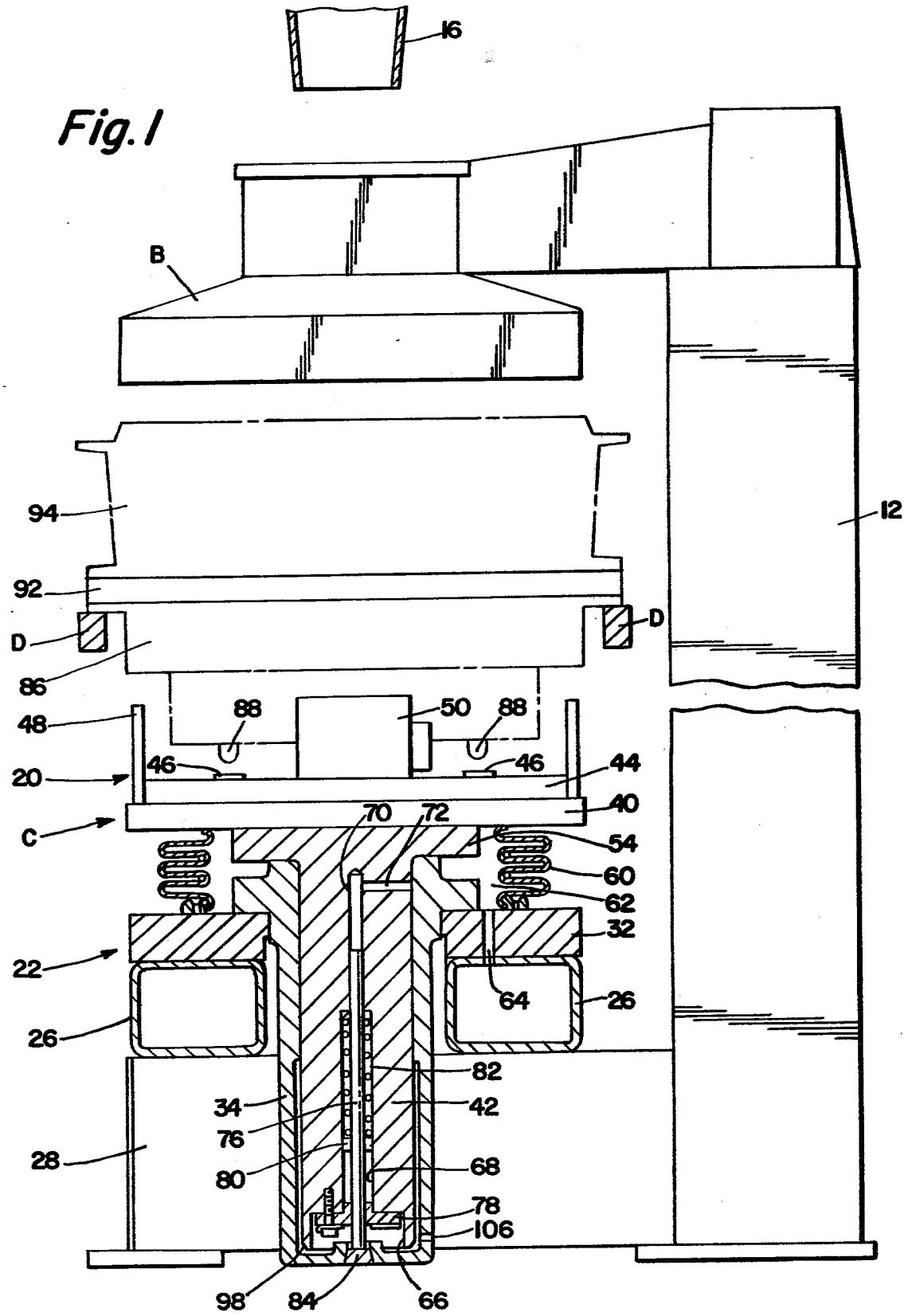
FIG. 1 is a side elevational view of a foundry sand molding machine having the improved support table of the present application incorporated therein, and with portions of the table being in section for clarity of illustration.

With reference to the drawing, a foundry sand molding apparatus includes an upright frame 12 supporting a head B carrying a downwardly facing squeeze board in a known manner. The head B may be swingable horizontally, or otherwise movable out of the way, to provide clearance for supplying sand therepast from an overhead chute 16.

A support table C includes an upper table structure 20 supported on a base structure 22. The base structure 22 includes frame members 26 supported on machine frame members 28. The base structure 22 also includes a frame plate member 32 supported on the frame members 26. An elongated cylinder 34 is suitably centrally bolted or otherwise secured to the frame plate 32 coincidental with the vertical axis along which the table moves.

The upper table structure 20 includes a lower plate member 40 having an elongated centrally located guide rod 42 suitably bolted or otherwise secured to the underside thereof. A plate member 44 secured to the plate member 40 has suitable sockets 46. A peripheral wall 48 is suitably secured to the plate member 40 and plate member 44. A pneumatically or electrically operated vibrator 50 is centrally bolted or otherwise secured to the plate member 44 for vibrating the table structure 20.

The guide rod 42 has a radial flange 54 which abuts the upper end of the guide cylinder 34 in the lowermost position of the table structure 20. A generally cylindrical flexible diaphragm or bellows member 60 is sealingly secured to the underside of the plate member 40 and the plate member 32 to define an air chamber 62 of an air motor. One or more passages indicated at 64 extend through the frame members 26, 32 for supplying air to the air chamber 62.

The bottom end of the guide rod 42 is recessed as at 66 and also provided with a centrally elongated bore 68. A central axial passage 70 entends from the bottom end of the bore 68 to intersection with a lateral passage 72 having an opening on the outer surface of the guide rod 42. A spring biased plunger positioned in the guide rod 42 includes an elongated cylindrical plunger rod 76 closely guided in the cylindrical passage 70 and closely guided through a central hole in a collar member 78 positioned in the recess 66 and suitably secured to the guide rod 42 as by bolts for closing the open end of the bore 68. A larger diameter plunger piston 80 is secured to the plunger rod 76 or integral therewith. Spring means in the form of a coil spring 82 acts between the bottom end of the bore 68 and the plunger piston 80 for normally biasing the plunger rod 76 outwardly of the collar 78 and against a plug member 84 in the bottom end of the guide cylinder 34.

The upper table structure 20 cooperates with a support member 86 having pins 88 receivable in the sockets 46. A cavity may be provided in the support 86 for the vibrator 50. A pattern plate 92 is positioned on the support member 86 and a flask 94 rests on the pattern plate 92 in surrounding relationship to the pattern thereon. The support member 86, the pattern plate 92, and the flask 94 are supported by suitable support structure D.

Figure 2:
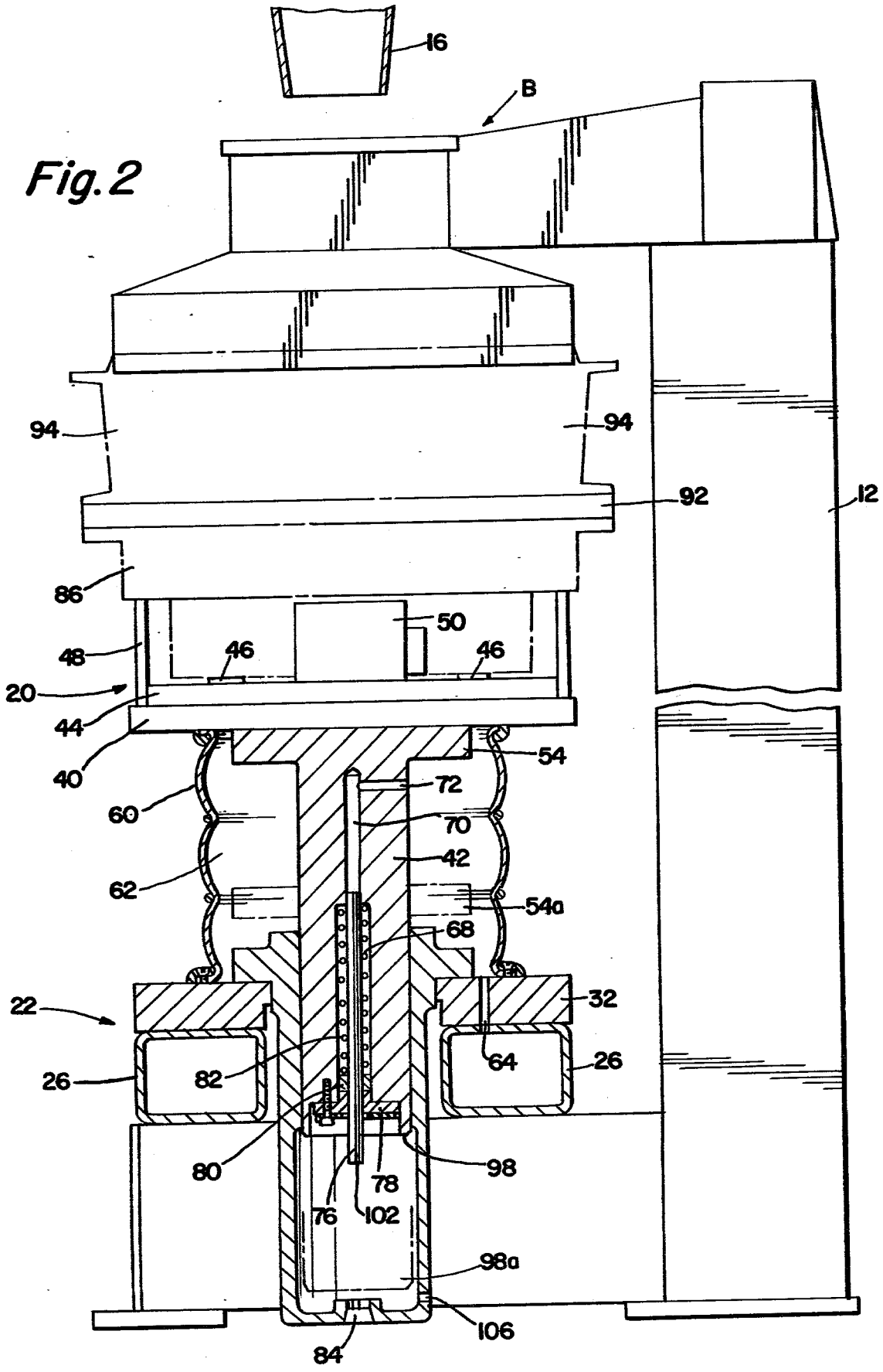
FIG. 2 is a view similar to FIG. 1 and showing the support table in an elevated position.

FIG. 1 shows the support table C in its lowermost position with the radial flange 54 bottomed out on the upper end of the guide cylinder 34. The spring 82 is acting against the plunger piston 80 in a direction for engaging the end of the plunger rod 76 with the plug 84 forming part of the bottom end of the guide cylinder 34. Head B is swung horizontally out of the way and regulated pressure air is supplied to the air chamber 62 through the passage 64 for elevating the upper table structure 20 to a sand supply position as shown in FIG. 2. When the upper table structure is raised the support 86 is raised away from support D.

Sand is then fed from the chute 16 into the flask 94 in covering relationship to the pattern surrounded thereby. The vibrator 50 is operated and the upper table structure 20 is relatively slowly lowered to a preset position wherein the flange 54 on the guide rod 42 is spaced slightly above the upper end of the guide cylinder 34 as shown at 54*a* in shadow lines in FIG. 2. The bottom end 98*a* of the guide rod is also spaced above the bottom end of the guide cylinder 34 as shown by the shadow lines in FIG. 2. This is slightly above the position for the guide rod end 98 in FIG. 1.

When the table structure C is elevated to the sand supply position as shown in FIG. 2, the spring 82 causes the plunger piston 80 to bottom out against the collar 78 and the bottom end 102 of the plunger rod 76 extends well outwardly from the bottom end 98 of the guide rod 42 toward the bottom end of the guide cylinder 34. As the table structure is lowered toward its predetermined or preset position depending upon the air pressure delivered to the chamber 62, the bottom end 102 of the plunger rod will engage the plug 84 forming part of the bottom end of the guide cylinder 34 to compress the spring 82 and aid the air motor in maintaining the table structure 20 in a slightly elevated floating position for optimum vibration thereof by operation of the vibrator 50. The table lowers due to the weight of the sand overcoming the upward force of the bellows 60.

It should be apparent that the air pressure in chamber 62 determines the preset position of the table structure. When in the preset position, the bellows 60 (which has a spring rate), the spring 82 and the air pressure set against the weight of the sand. The air pressure is controlled by a suitable manually controlled regulator (not shown) so as to determine the preset position.

Once the head B has been moved back into a vertically aligned position above the support table C, full air pressure is supplied to the air chamber 62 for elevating the table structure 20 and squeezing the sand in the flask 94 against a squeeze board carried by the head B. The vibrator 50 is operated continuously in all elevated positions of the table. Once the squeezing position is completed, the table structure is again lowered to its lowermost position shown in FIG. 1 for removal of the completed sand mold. The cycle of operation is then repeated.

The guide cylinder 34 has a port 106 which is connected to the same source of air pressure as the passage 64. Air pressure supplied directly to the guide cylinder 34 will act on the guide rod 42 and acts with the air pressure in the air chamber 62.

It should be apparent that with the spring 82 used for aiding the air motor in maintaining the table structure in the predetermined or preset position, vibrations are isolated from conveyor or table supports D. Also, it should be apparent that the motor 60 functions to prevent rotation of the plate 40 and parts connected thereto. Further, the above described structure functions in that the table 20, support 86, pattern 92, and flask 94 all move along a vertical axis and in a parallel relation on both raising and lowering movement.

Although the invention has been shown and described with respect to a preferred embodiment, it is obvious that equivalent alterations and modifications will occur to others skilled in the art upon the reading and understanding of this specification. The present invention includes all such equivalent alterations and modifications, and is limited only by the scope of the claims.

We claim:

1. A foundry sand molding apparatus comprising a vertically movable upper table structure, said upper table structure adapted to support a flask thereon, a base structure including a support portion for engaging said upper table structure in the lower position of said upper table structure and means for guiding said upper table structure for vertical movement along the vertical axis of said upper table structure, air motor menas for elevating said upper table structure vertically from the lowermost position to a sand supply position whereat sand is supplied to the flask, means including said motor means for lowering said upper table structure from said supply position to a preset position slightly elevated above said support portion, vibrator means mounted on said upper table structure for vibrating the same and the flask when said upper table structure is slightly elevated above said lowermost position and out of contact with said support portion, and said air motor means being further operative to elevate said upper table structure from said preset position to a sand squeezing position, spring means for acting between said base structure and said upper table structure for applying an upward force to said upper table structure to aid said air motor means in positioning said upper table structure to said preset position slightly elevated above said lowermost position and means for causing said spring means to apply said upward force in response to downward movement of said upper table structure into a position adjacent said preset position.

2. A foundry sand molding apparatus comprising a vertically movable upper table structure, said upper table structure adapted to support a flask thereon, a base structure including a support portion for engaging said upper table structure in the lowermost position of said upper table structure and means for guiding said upper table structure for vertical movement along the vertical axis of said upper table structure, air motor means for elevating said upper table structure vertically from the lowermost position to a sand supply position whereat sand is supplied to the flask, means including said motor means for lowering said upper table structure from said supply position to a preset position slightly elevated above said support portion, vibrator means mounted on said upper table structure for vibrating the same and the flask when said upper table structure is slightly elevated above said lowermost position and out of contact with said support portion, and said air motor means being further operative to elevate said upper table structure from said preset position to a sand squeezing position, wherein said air motor means includes a generally cylindrical flexible diaphragm having one end secured to said upper table structure and another end secured to said base structure and defining an air chamber therebetween, and said means for guiding said upper table structure for vertical movement includes rigid guide means between said upper table structure and said base structure, said rigid guide means being positioned in the center of said base structure and extending through said cylindrical flexible diaphragm.

3. A foundry sand molding apparatus as defined in claim 1 wherein said spring means is disposed to be compressed between said upper table structure and said base structure as said upper table structure is lowered toward said preset position from said position adjacent said preset position by guide rod which engages said base structure when said upper table structure is in said position adjacent said preset position.

4. A foundry sand molding apparatus comprising a vertically movable upper table structure, said table structure adapted to support a flask thereon, a base structure including a support portion for engaging said table structure in the lowermost position of said table structure, said base structure including means for guiding said table structure for vertical movement along the vertical axis of said table structure, air motor means for elevating said table structure vertically from the lowermost position thereof to a sand supply position whereat sand is supplied to the flask, means including said air motor means for lowering said table structure from said sand supply position to a position slightly elevated above said support portion of said base structure, vibrator means mounted on said table structure for vibrating the same and the flask when said table structure is in said position slightly elevated above said support portion, said air motor means being further operative to elevate said table structure from said position slightly elevated above said support portion to a sand squeezing position, said air motor means including a generally cylindrical flexible diaphragm secured between said table structure and said base structure and defining an air chamber therebetween, said guide means comprising an elongated vertical guide cylinder on said base structure slidably receiving a guide rod engaging said table structure and extending downwardly through said air chamber, spring means disposed to be compressed between said table structure and said guide cylinder as said table structure is lowered toward said lowermost position for biasing said guide cylinder and guide rod toward said position slightly elevated above said support portion to aid said air motor means in maintaining said table structure in said position, said guide cylinder having a bottom end and said guide rod having a rod end facing said cylinder bottom end, a central elongated bore extending upwardly into said guide rod from said rod end, a plunger received in said bore and having one plunger end facing said cylinder end, and said spring means comprising a spring positioned in said bore between said plunger and the bottom end of said bore.

5. A support table for a foundry sand molding machine comprising a table for supporting a flask to be filled with sand, said table being supported on a base structure for movement along a substantially vertical axis, air motor means for elevating and lowering said table along said vertical axis, said air motor means including a generally cylindrical flexible diaphragm surrounding said vertical axis and secured between said table and base structure and defining an air chamber therebetween, said base structure including an elongated guide cylinder circumscribing said vertical axis, said table having an elongated guide rod secured thereto and extending through said air chamber and into said guide cylinder, conduit means for directing air to said air chamber, spring means disposed to act between said base structure and said guide rod as said guide rod approaches a lowermost position resting on said base structure for biasing said guide rod in an elevating direction relative to said lowermost position, said spring means being insufficient by itself to elevate said table from said lowermost position, said table having a sand supply position with said table disposed at the upper limit of the vertical axis, said table having a preset position with said table disposed intermediate the lowermost position and the sand supply position, said air motor means moving said table between the lowermost, sand supply and preset positions, said spring means biasing said table away from the lowermost position to assist said air motor in moving said table to the preset position, said guide rod having an axial bore therein, said spring means comprises a spring biased plunger received in said bore, and said plunger having a plunger end engageable with the bottom of said guide cylinder in said preset position of said table.

6. The apparatus as defined in claim 4 including an axial passage extending into said guide rod from said bottom end of said bore and intersecting a lateral passage having a lateral passage opening on the outer surface of said guide rod, said plunger including a plunger rod closely received in said axial passage and having a piston thereon closely received in said bore, a collar closing the open end of said bore and having a hole therethrough closely receiving said plunger rod, said spring acting between said bore bottom and said piston for biasing and plunger rod outwardly of said collar, said lateral passage opening being out of communication with said air chamber in said lowermost position and being in communication therewith in other positions of said upper table structure.

* * * * *

UNITED STATES PATENT AND TRADEMARK OFFICE

CERTIFICATE OF CORRECTION

PATENT NO. : 4,202,399

DATED : May 13, 1980

INVENTOR(S) : Edward D. Abraham and Rodney L. Hartung

It is certified that error appears in the above-identified patent and that said Letters Patent are hereby corrected as shown below:

Column 6, line 45, change "and" to --said--.

Signed and Sealed this

*Thirtieth* Day of *September 1980*

[SEAL]

*Attest:*

SIDNEY A. DIAMOND

*Attesting Officer*

*Commissioner of Patents and Trademarks*